US009028024B2

(12) United States Patent
Barbet et al.

(10) Patent No.: US 9,028,024 B2
(45) Date of Patent: May 12, 2015

(54) BINARY CONTINUOUS INKJET PRINTER WITH A DECREASED PRINTHEAD CLEANING FREQUENCY

(75) Inventors: Bruno Barbet, Etoile-sur-Rhone (FR); Damien Bonneton, Hostun (FR)

(73) Assignee: Markem-Imaje, Bourg-les-Valence (FR)

( * ) Notice: Subject to any disclaimer, the term of this patent is extended or adjusted under 35 U.S.C. 154(b) by 0 days.

(21) Appl. No.: 13/983,544

(22) PCT Filed: Feb. 8, 2012

(86) PCT No.: PCT/EP2012/052083

§ 371 (c)(1), (2), (4) Date: Aug. 2, 2013

(87) PCT Pub. No.: WO2012/107461

PCT Pub. Date: Aug. 16, 2012

(65) Prior Publication Data

US 2013/0307891 A1 Nov. 21, 2013

Related U.S. Application Data

(60) Provisional application No. 61/469,280, filed on Mar. 30, 2011.

(30) Foreign Application Priority Data

Feb. 9, 2011 (FR) ..... 11 51030

(51) Int. Cl.
*B41J 2/02* (2006.01)
*B41J 2/045* (2006.01)
(Continued)

(52) U.S. Cl.
CPC ..... *B41J 2/04588* (2013.01); *B41J 2/03* (2013.01); *B41J 2/105* (2013.01); *B41J 2/115* (2013.01)

(58) Field of Classification Search
USPC ..... 347/10, 73, 64, 76, 77, 82
See application file for complete search history.

(56) References Cited

U.S. PATENT DOCUMENTS 3,373,437 A 3/1968 Sweet et al.
4,613,871 A 9/1986 Katerberg
(Continued)

FOREIGN PATENT DOCUMENTS

EP 1277580 A1 1/2003
FR 2906755 4/2008
(Continued)

OTHER PUBLICATIONS

International Search Report issued May 16, 2012 in International Application No. PCT/EP2012/052083.
(Continued)

*Primary Examiner* — Huan Tran
(74) *Attorney, Agent, or Firm* — Miles & Stockbridge P.C.

(57) ABSTRACT

The invention relates to a new control method for controlling the printing of a binary continuous inkjet printer provided with a printhead (20) with a set of deflection electrodes (8*a*, 8*b*; 9*a*, 9*b*) shared by all of the nozzles of the head, at least one pair of electrodes (8, 9) supplied in phase opposition relative to each other, and actuators (6) to which pulses are sent to form a distance Lbr from the plane of the nozzles (11), from the break of a jet discharged by a nozzle (3) in communication with a stimulation chamber (2) to which said actuator is mechanically coupled, drops not able to be electrically charged or jet segment subjected to the electrostatic influence of the deflection electrodes.
According to the invention, the pulses are controlled so as to minimize the total electrical charge taken on by the ink jet segments inside a volume of influence of the electrodes.

9 Claims, 4 Drawing Sheets

(51) Int. Cl.

| | |
|---|---|
| ***B41J 2/03*** | (2006.01) |
| ***B41J 2/105*** | (2006.01) |
| ***B41J 2/115*** | (2006.01) |

(56) References Cited

U.S. PATENT DOCUMENTS

| | | | |
|---|---|---|---|
| 4,636,808 | A | 1/1987 | Herron |
| 4,730,197 | A | 3/1988 | Raman et al. |
| 7,192,121 | B2 | 3/2007 | Barbet et al. |
| 8,162,450 | B2 | 4/2012 | Barbet |
| 2003/0043239 | A1 | 3/2003 | Yamada et al. |
| 2003/0063166 | A1 | 4/2003 | Jeanmaire |
| 2003/0193551 | A1 | 10/2003 | Jeanmaire |
| 2008/0143766 | A1 | 6/2008 | Hawkins |
| 2008/0231669 | A1 | 9/2008 | Brost |
| 2010/0033543 | A1 | 2/2010 | Piatt et al. |
| 2010/0045753 | A1 | 2/2010 | Barbet |
| 2011/0109677 | A1 | 5/2011 | Montz et al. |
| 2011/0216136 | A1 | 9/2011 | Barbet et al. |

FOREIGN PATENT DOCUMENTS

| | | | |
|---|---|---|---|
| FR | 2938207 | A1 | 5/2010 |
| RU | 2055319 | * | 2/1996 |

OTHER PUBLICATIONS

French Preliminary Search Report issued Jan. 20, 2012, in French Application No. 1 154 652.

* cited by examiner

BINARY CONTINUOUS INKJET PRINTER WITH A DECREASED PRINTHEAD CLEANING FREQUENCY

TECHNICAL FIELD

The invention relates to binary continuous inkjet printers provided with a multi-nozzle drop generator.

It concerns the decrease of the cleaning frequency of these printheads.

BACKGROUND OF THE INVENTION

It is specified here that, in the whole application, the terms "lower" and "upper," respectively "below" and "above," "upstream" and "downstream" should be understood with a printhead oriented downwards, i.e. with the drop generator above electrodes of the head and a direction of inkjet flow (segments or drops) downwards. Thus, the lower end of an electrode designates the end that is on bottom. Likewise, the further downstream electrode of a pair designates the electrode of that pair in last place opposite an inkjet segment formed or an ink drop formed from a nozzle of the printhead.

It is specified that, by convention, an even jet segment and an odd jet segment (with opposite parity) are defined to designate two jet segments respectively coming from two nozzles arranged to be adjacent in the printhead according to the invention.

A printhead for a binary continuous jet printer is described in the application for patent US 20100045753 in the applicant's name. Such a printhead comprises a so-called multi-nozzle generator with a body including one or several ink intake conduits communicating with a plurality of stimulation chambers to pressurize the ink therein. Each stimulation chamber is in communication with an ink discharge nozzle via a conduit. Each stimulation chamber is mechanically coupled with a single actuator. A given actuator is arranged relative to the body so as to cause, by electrical pulse, a stimulation in the stimulation chamber, typically a pressure wave in the volume of ink contained in the stimulation chamber. All of the nozzles are aligned along an alignment axis and arranged in a same plane.

The continuous inkjet printer is also provided with control means able to send electrical pulses to each actuator and detection means able to detect the relative position between the printhead and a printing medium.

During operation, the pressurized ink is discharged from one or several stimulation chambers through the conduit(s) and the corresponding discharge nozzle(s). The ink discharged from each nozzle then forms a jet having a determined speed. At the outlet of the nozzle, and for a short distance, the trajectory of the jet coincides with the longitudinal axis of the nozzle.

Each stimulation of the ink contained in a chamber by the associated actuator causes a break in the jet of ink discharged from the nozzle. A shorter length between two consecutive stimulations causes the formation of drops, while a longer duration causes the formation of jet segments. The jet segments thus formed are deflected from their initial trajectory and recovered by a recovery gutter. The drops, which are not deflected, leave the printhead to impact a printing support. The continuous jet printing technology thus implemented is called binary because there may or may not be deflection, in a binary manner.

The deflection of the jet segments is obtained by deflection electrodes whereof the electrical power causes the appearance of electrical charges on the surface of the jets. The jet portions thus charged, which, after breaking of the jet, will form segments, are attracted towards said electrodes, which deflects them from their initial trajectory. By construction, the deflection electrodes are arranged sufficiently downstream of the discharge nozzles to have no electrostatic influence on the drops formed upstream of said electrodes.

The deflection electrodes are grouped together in pairs, each electrode of a pair being supplied in phase opposition with the other electrode in the pair. It is thus possible to obtain a total electrical charge supported by a jet segment that is zero or weak.

In operation, the printing support moves forward perpendicularly to the alignment axis of the nozzles and its relative position relative to the printhead is detected. At each relative position where it is necessary to perform ink printing, a position cue is sent to the printing control means. Upon receiving that cue, these printing control means send an electrical stimulation pulse to the actuator(s) needing to be stimulated to obtain the desired printing pattern. In other words, each position cue has a corresponding printing of what is called a screen.

The inventors noticed that after a certain operating duration of a binary continuous inkjet printer as described above, ink was dirtying the deflection electrodes to the point of damaging their effectiveness and sometimes causing malfunctions of the printer.

This flaw is remedied by a periodic operation consisting of systematically cleaning the electrodes. This periodic operation does, however, have the major drawback of interrupting printing.

The aim of the invention is then to propose a solution making it possible to increase the printing period of a binary continuous inkjet printer, between two consecutive cleaning operations to clean its printhead.

BRIEF DESCRIPTION OF THE INVENTION

To that end, the invention relates to a control method for controlling printing by a binary continuous inkjet printer provided with a printhead, or a printhead of such a printer in order to print a pattern on a printing medium in motion relative to the head, the head for example being of the type described by patent application US 2010/0045753, comprising:

- a generator, called multi-nozzle drop generator, comprising:
  - a body including:
    - stimulation chambers each able to receive pressurized ink,
    - discharge nozzles, each in communication with a stimulation chamber and each able to discharge a jet of ink along its longitudinal axis, the nozzles being aligned along an alignment axis and arranged in a same plane,
  - actuators, each mechanically coupled to a stimulation chamber, and able to cause, on pulse control, a break of a jet discharged by a nozzle in communication with said chamber at a distance lbr from the plane of the nozzles,
  - a deflection block arranged below the nozzles and including, from upstream to downstream:
    - a shielding electrode,
    - a first dielectric layer adjacent to the shielding electrode,
    - at least one pair of deflection electrodes, each deflection electrode being surrounded on either side by a dielectric layer,
- according to which method:
  - information is determined on the relative position of the medium in relation to the head, the electrodes of a same pair are supplied, with alternating voltage, in phase opposition relative to each other, pulses are sent to the actuators to form, from the break of a jet discharged by a nozzle in communication with the chamber to which said actuator is mechanically coupled at a distance lbr from the plane of the nozzles, drops not able to be electrically charged by the deflection electrodes or jet segments subject to the electrostatic influence of the deflection electrodes, the pulses are controlled so as to minimize the total electric charge on the jet segments, which is contained inside the electrostatic influence volume of the deflection electrodes.

It is possible to define geometrically, according to the invention, a volume of influence of the electrodes as being delimited:

on one hand, by two planes parallel to the plane of the nozzles usually called nozzle plate with a first situated downstream of the shielding electrode and upstream of the electrode furthest upstream, and a second immediately downstream of the lower end of the electrode furthest downstream;

on the other hand, by an envelope surface closed perpendicular to the plane of the nozzles and surrounding all of the trajectory portions of the jets or jet segments between the first and second planes.

This envelope surface can itself be defined as being delimited by two other pairs of planes, the planes of one pair being parallel to each other and perpendicular to the planes of the other pair. One of the pairs of planes is thus made up of planes perpendicular to the alignment axis of the nozzles, and the other pair is made up of planes parallel to the axes of the nozzles. By thus defining the envelope surface, the trajectories of the jets or jet segments subjected to the electrostatic influence of the electrodes are all present between the planes of a pair.

The method according to the invention is applicable to a printer or to a printhead of a printer in that the control means cannot be part of the printhead, or on the contrary can be part of it or may also be distributed in part on the printer and in part on the printhead.

Owing to the method according to the invention, the presence of microdroplets of ink is avoided in the electrostatic influence volume of the deflection electrodes, which themselves are attracted by said electrodes, and one thereby avoids premature soiling thereof during printing operation.

BRIEF DESCRIPTION OF THE FIGURES

Other advantages and features of the invention will better emerge from reading the detailed description done in reference to the following figures, in which.

DETAILED DESCRIPTION OF SPECIFIC EMBODIMENTS

Figure 1:
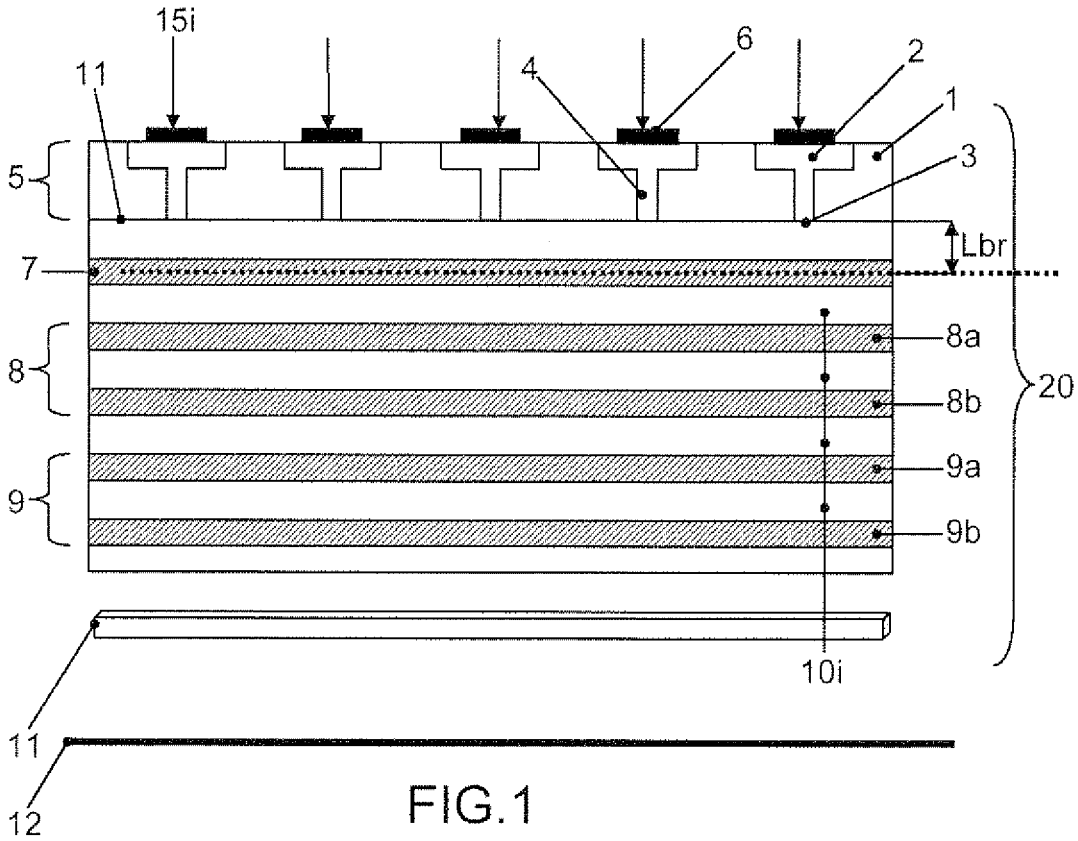
FIG. 1 is a longitudinal diagrammatic cross-sectional view of part of a printhead according to the invention.
Figure 2:
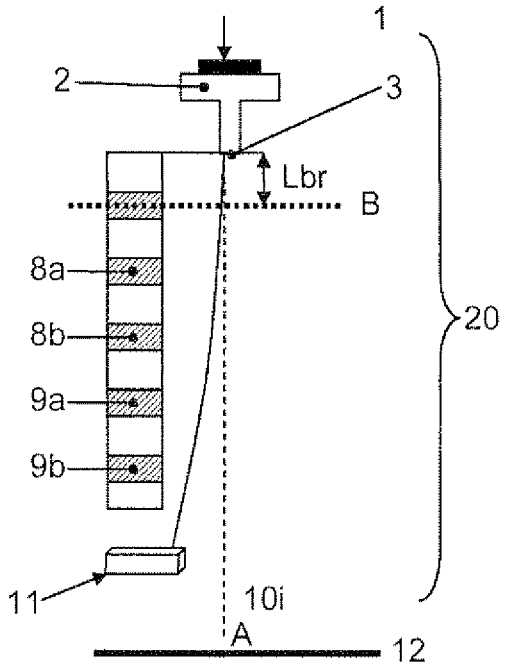
FIG. 2 is a diagrammatic transverse cross-section of the print head according to FIG. 1, FIG. 3 diagrammatically illustrates a top view of a printhead essentially showing a preferred arrangement of the chambers and actuators and the control means of the actuators of a printhead according to the invention.
Figure 3:
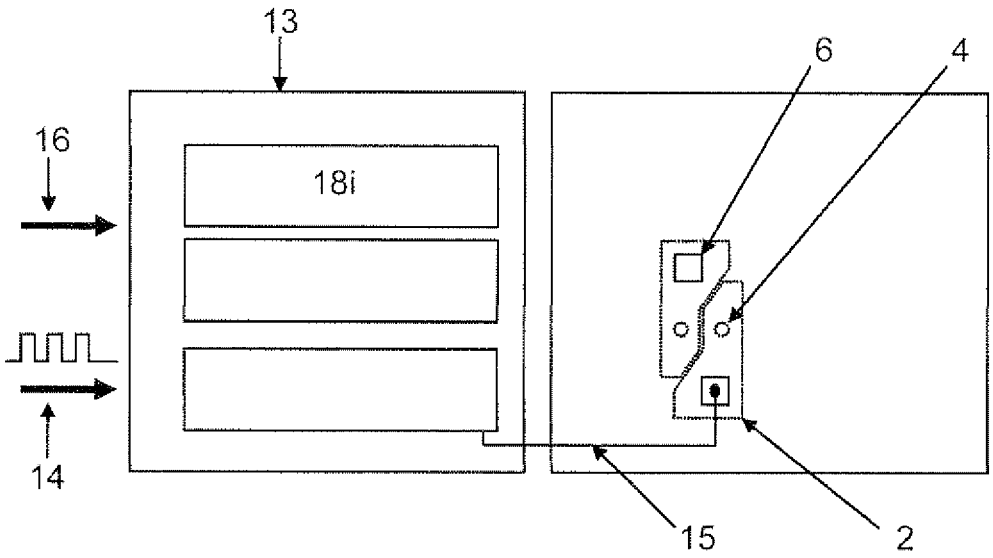

FIGS. 1 to 3 show an example of a printhead according to the invention, implementing the binary continuous jet technology.

The head comprises a so-called multi-nozzle generator with a body 1, including one or several rows of stimulation chambers 2. The body 1 can be made by assembling plates to each other, for example using a diffusion bonded technique or gluing as described in U.S. Pat. No. 4,730,197. For more details on the multi-nozzle drop generator, and in particular for details relative to the ink inlets, ink tank and restrictions, see also the explanations provided in U.S. Pat. No. 7,192,121. The stimulation chambers 2 can in particular be arranged as described in U.S. Pat. No. 4,730,197 relative to FIG. 6 of that patent and shown diagrammatically in FIG. 3 of this application.

Each stimulation chamber 2 is in hydraulic communication with a nozzle 3 via a conduit 4. As shown, all of the nozzles 3 are aligned along an alignment axis and they are arranged in a same plane 11. These nozzles 3 are generally made in a same plate, usually called "nozzle plate," and the bottom surface of which constitutes the plane 11.

Actuators 6 are each mechanically coupled with one of the chambers 2 and electrically connected to a feeder 15. As shown, the actuators 6 are piezoelectric actuators arranged above a wall of the chambers. Thermal generators can also be provided arranged inside the stimulation chambers 2. The body 1 and the actuators 6 together form a so-called multi-nozzle drop generator 5.

During operation, pressurized ink is introduced into the chambers 2. Jets of ink are then discharged from the nozzles 3. Each jet thus has, at the outlet of the nozzle, a trajectory combined with the longitudinal axis A of the concerned nozzle 3. The jets of ink therefore flow at the furthest upstream level corresponding to the outlet of the nozzle 3.

The printhead also includes a set of electrodes arranged below the multi-nozzle generator 5 and laterally shifted relative to the plane containing the axes A of the nozzles 3.

This assembly first comprises a first electrode 7 immediately downstream of the nozzles 3. This electrode is called a shielding electrode 7 because it is at the same electric potential as the ink present in the stimulation chambers 2.

Arranged downstream of the shielding electrode 7 are deflection electrodes grouped in pairs from the furthest upstream. Each pair includes an upstream odd electrode followed by a downstream even electrode. The illustrated example includes two pairs of deflection electrodes 8, 9 whereof the one furthest upstream comprises two electrodes 8*a*, 8*b* and the one furthest downstream 9 includes electrodes 9*a*, 9*b*. The electrodes 8*a*, 8*b* or 9*a*, 9*b* of a same pair are supplied in phase opposition relative to each other by an alternating voltage.

A dielectric layer 10*i* is arranged between two consecutive electrodes 7, 8*a*, 8*b*, 9*a*, 9*b*.

Lastly, a recovery gutter 11 for the ink not used for printing is arranged downstream of the set of electrodes 7, 8*a*, 8*b*, 9*a*, 9*b*.

The body 1, the actuators 6 and their feeders 15, the shielding electrode 7, the deflection electrodes 8*a*, 8*b*, 9*a*, 9*b*, the dielectrics 10, the ink recovery gutter 11 together form the printhead 20.

As shown in FIG. 3, control means 13 for controlling the actuators 6 can also be incorporated into the printhead 20, partially or completely, or can simply be electrically coupled, for example by cable, to said head.

The operation of such a printhead is as follows:

The printhead 20 and a printing support 12 are in motion relative to each other.

The actuators 6 are controlled by the control means 13. Thus, the control means 13 receive, as input, data 16 on the relative position between the printhead 20 and the printing medium 12 and information 14 on a pattern to be printed (see arrows 14 and 16 in FIG. 3).

The control means 13 include one or several microprocessors and memories 18 containing software and able to store the input data relative to the pattern to be printed.

Thus, the control means 13 control jet breaks by sending, at a given moment, electrical pulses to each of the actuators via feeders 15. The printing instructions are timed by a reference clock having a period $p_h$ and therefore a frequency $f_h=1/p_h$. Each time that, as a function of the relative position between the printhead 20 and the printing support 12, a drop of ink coming from one of the nozzles 3 is necessary for printing, the control means 13 control the sending of two consecutive pulses to the concerned actuator 6, from the chamber 2 in communication with said nozzle 3.

A drop of ink is thus formed.

The break distance Lbr is the distance between the outlet of the nozzle 3 and the break point.

The break distance is identical for all of the nozzles and is therefore shown in FIGS. 1 and 2, by an axis in dotted lines B. The break is provided so that the break axis B of the jet is always at a distance Lbr from the plane 11, smaller than the distance separating that same plane 11 from the lower end of the shielding electrode 7. In other words, the break axis B is always included in the space delimited by the thickness of the shielding electrode 7. The drops thus formed are said to be unable to be electrically charged. In this way, the drops are formed at a point where they do not undergo any electrostatic influence from the deflection electrodes 8*a*, 8*b*; 9*a*, 9*b* and are therefore not deflected by said pairs of deflection electrodes 8, 9. These non-deflected and non-intercepted drops will impact the printing medium 12.

Between two consecutive drops intended for printing, jet segments are formed since the pressurized ink is still sent into the stimulation chambers 2. These jet segments have a length longer than the distance separating the break axis B from the upper end of the deflection electrode 8*a* furthest upstream. These segments therefore undergo the electrostatic influence at minimum of the electrode 8*a* and possibly, depending on their length, those of the downstream electrodes 8*b*, 9*a*, 9*b*. In other words, the inkjet segments therefore undergo the electrostatic influence of at least one of these deflection electrodes 8*a* to 9*b* and are therefore deflected towards the recovery gutter 11. Reference may also be made to patent application FR 2906755, which also describes such a printhead 20 and its operation.

To better explain the invention, FIGS. 4A to 4E show different jet segment length configurations obtained for a same absolute value of the voltage applied to the deflection electrodes 8, 9 at the moment of the break forming the segment. As mentioned above, the electrodes 8*a*, 8*b* or 9*a*, 9*b* of a pair are supplied in phase opposition relative to each other by an alternating voltage. Thus, at the moment of the break of a given segment, charges are distributed on its surface, but the total charge taken on is minimized. Indeed, if positive charges appear in the upstream part of the segment under the electrostatic influence of the electrode 8*a*, negative charges appear in its downstream part under the electrostatic influence of the electrode 8*b*, in phase opposition relative to the electrode 8*a*. Charges being present on the surface of the segment before the break moment, the latter undergoes a deflection such that it is oriented towards the gutter 11.

Figure 4:
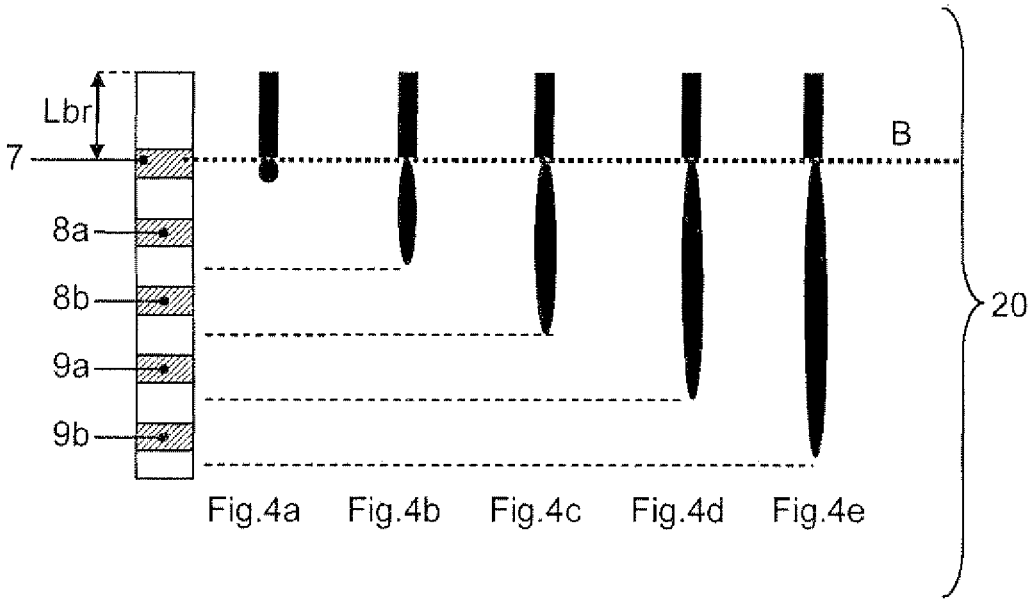
FIGS. 4A to 4E show different ink jet break configurations obtained by the printhead according to FIGS. 1 and 2.

Thus, FIG. 4A shows the configuration in which only a drop is formed, intended for printing. As explained above, this drop is formed in the space opposite the shielding electrode 7 and therefore does not receive any electrical charge. It is thus not deflected by the deflection electrodes 8, 9 and will impact the printing support.

FIG. 4B shows the configuration in which a jet segment is formed with a large enough length to face the electrode 8*a* furthest upstream, but too short to face one of the other electrodes downstream of the electrode 8*a*. The charges created on this jet segment therefore depend on one hand on the value and on the other hand on the sign of the potential applied to the electrode 8*a* between the moment when the segment starts to face that electrode and the break moment. Thus, under the electrostatic influence of the electrode 8*a*, this segment is deflected. Moreover, this segment takes on charges whereof the value depends on the value of the potential on the electrode 8*a* at the time of the break.

FIG. 4C shows the configuration in which a jet segment is formed with a large enough length to face the electrode 8*b*, but too short to face one of the electrodes further downstream than the electrode 8*b*.

FIG. 4D shows the configuration in which a segment is formed with a large enough length to face the electrode 9*a* of the pair 9 of electrodes downstream of the pair 8, but too short to face the electrode 9*b* of that same pair. In this configuration of FIG. 4D, the charges created by the upstream segment part facing the electrodes 8*a* and 8*b*, respectively, have opposite signs, since the electrodes 8*a* and 8*b* are in phase opposition. The segment part that is facing the electrode 9*a* takes on, at the moment of the break, a charge that is not offset by a charge with the opposite sign. The result is that a charge is taken on.

Lastly, FIG. 4E shows the configuration in which a segment is formed with a large enough length to face all of the electrodes of both pairs 8, 9. In this configuration of FIG. 4E, there are charges distributed all along the segment, but the total value of the charges taken on at the moment of the break is minimized because the charges due to the upstream electrodes 8*a* and 9*a* of each pair have signs opposite the charges created on the segment parts facing the downstream electrodes 8*b* and 9*b* of each pair.

Figure 5:
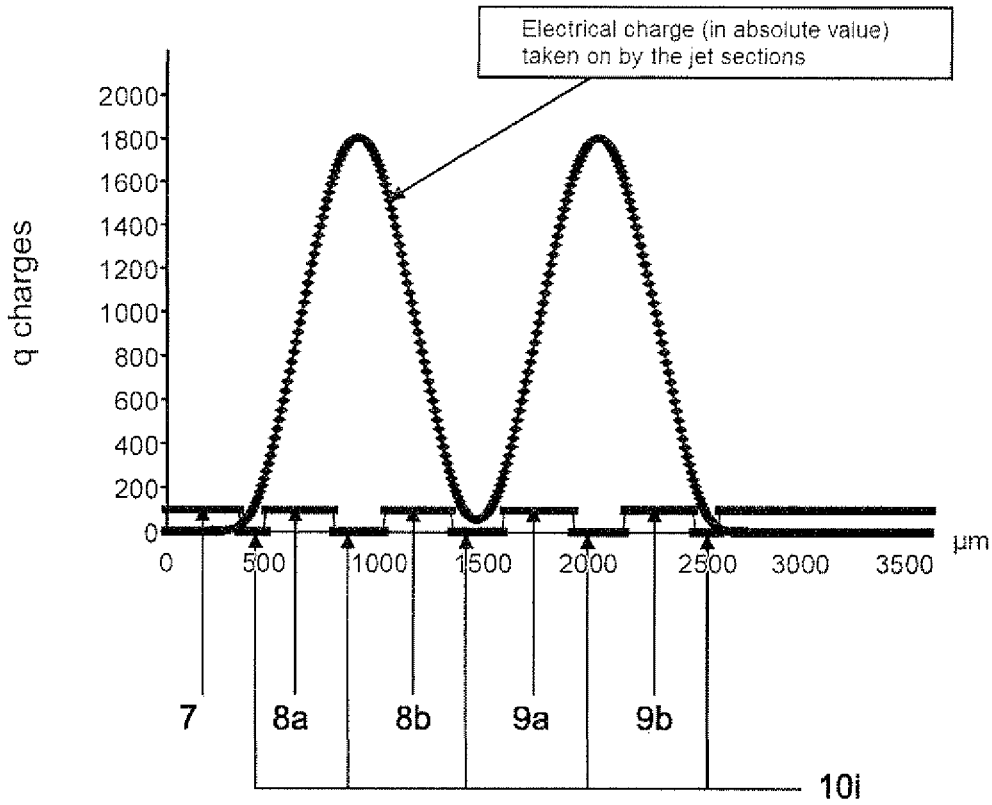
FIG. 5 is a curve showing the charge quantity (in Coulomb C) taken on by a jet segment, coming from a printhead according to FIGS. 1 to 3, as a function of the length of said segment in (μm)

FIG. 5 illustrates the representative curve of the total charge taken (on expressed in unit proportional to Coulomb (C)) by a jet segment at the moment of its break as a function of its length expressed here in μm. In this FIG. 5, we have also shown, on the X axis, the dielectric separating layers 10*i* between electrodes, and parallel to the X axis the electrodes 7, 8*a*, 8*b*, 9*a* and 9*b*. We have thus shown, in correspondence, the total value of the electrical charges taken on by the jet segments with their relative position in relation to the deflection assembly. The curve thus clearly shows that:

- the total charge maximums taken on appear when the length of the jet segment is large enough for its downstream part to be opposite the middle of the dielectric layer 10*i* separating the two electrodes of a same pair, which corresponds approximately to the configurations of FIGS. 4B and 4D;

the total charge minimums taken on appear when the length of the jet segment is large enough for its downstream part to be opposite the middle of the dielectric layer 10*i* separating the two consecutive pairs of electrodes 8, 9, or is downstream of the lower end of the electrode 9*b* furthest downstream, which approximately corresponds to the configurations of FIGS. 4C and 4E, respectively.

The inventors have shown that in fact the total charge taken on by a jet segment was only minimized in two very precise configurations: downstream end of the jet at the break moment opposite the dielectric layer 10*i* separating two pairs of electrodes or downstream of the lower end of an even electrode 9*b* the furthest downstream.

In other words, the total charge taken on has a certain value. And the higher that value, the more the jet segment may be unstable from a hydraulic perspective: under the combined effect of the pressure generated by the electrostatic influence and the superficial voltage forces, microdroplets of ink can be discharged from the segment. However, the segment being charged, these microdroplets discharged from the segment are also electrically charged. Having a very small mass by nature, these microdroplets are very sensitive to the ambient electrostatic field at the moment of their creation. This ambient electrostatic field is a complex combination resulting from the potential of the electrodes, the values and distances of the electrical charges present on the jets and jet segments close to the microdroplets at the time of the break. And the inventors have observed that it is in particular these microdroplets that generally adhere on one or several of the electrodes. Thus, although the discharge of microdroplets is random, a pile of material builds up continuously on the electrodes, until it harms the proper operation of the printhead.

Thus, the inventors sought to avoid the creation of microdroplets just explained as much as possible, and therefore they proposed the solution according to the invention, i.e. controlling the pulses so as to minimize the charge taken on by one or several jet segments contained in elementary volumes, themselves situated inside the electrostatic influence volume of the electrodes. According to a first embodiment of the invention, one seeks to minimize the charge taken on in a first set of elementary volumes including trajectory portions of two adjacent jets. It is again specified here that two adjacent jets are two jets discharged from the two nozzles arranged adjacent to each other in the nozzle plate. In this first set of elementary volumes, one thus chooses two first planes that surround one and only one electrode. Two pairs of second planes are situated so as to surround the trajectories of only two adjacent jets. The first set of elementary volumes is thus formed by all of the surrounding volumes in an electrostatic influence volume of a single electrode a volume containing only two adjacent jets. Subsequently, these two jets having different parities, one of the jets is called odd jet and the other of the two jets is called even jet.

According to this first embodiment, the electric charge contained in one of the elementary volumes is minimized by controlling the pulses at the actuators 6 to form even jet segments, while the phase of the supply potential for the electrode 8*a* has a value $\phi$, and the pulses are controlled to form odd jet segments to form segments when the phase of the supply potential of the electrode 8*a* has a value of ($\phi$+180°) or close to that value ($\phi$+180°). Close to $\phi$+180°, in the context of the invention, refers to a phase between ($\phi$+160°) and ($\phi$+200°). Thus, the odd jet segments are charged in phase opposition relative to the even jet segments and therefore together take on charges whereof the algebraic sum is minimized. Preferably, the pulses are sent so as to obtain the break when the absolute value of the potential of the voltage of the deflection electrode 8*a* is zero or close to 0. Absolute value of the voltage of the deflection electrode close to 0 refers to a maximum value equal to 20% of the peak value of that voltage. Since two adjacent jet segments are electrically not very charged, and in any event are charged by charges with opposite signs, the microdroplets that may be discharged from either of the two jet segments adjacent to each other are better attracted by the adjacent segment with opposite polarity than by the deflection electrodes. The segments being continuously collected by the recovery gutter of the printhead, the microdroplets are evacuated continuously therefrom without causing soiling on the deflection electrodes.

Figure 6:
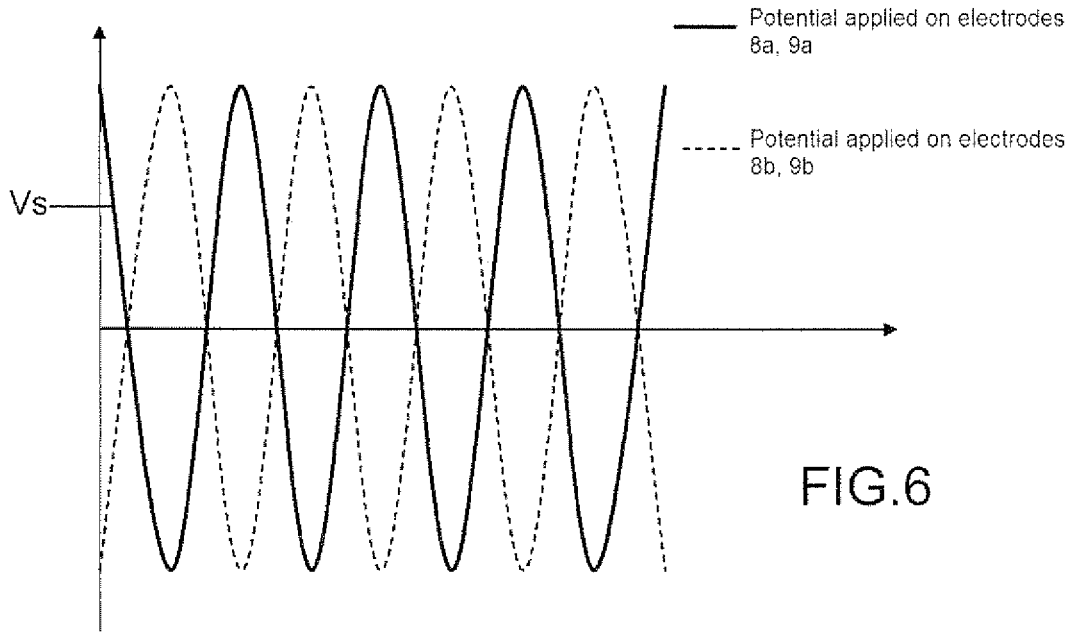
FIG. 6 shows, in solid lines, the supply voltage of pairs of deflection electrodes, according to the inventive method.

A first alternative to obtain control of the actuators 6, so as to form an odd jet segment, while the phase of the supply potential of the electrode 8*a* has a value $\phi$, and to form a segment from an adjacent even jet while the phase of the supply potential of that same electrode 8*a* has a value close to ($\phi$+180°) is described below relative to FIG. 6. FIG. 6 shows, in solid lines, the value of the alternating supply voltage of the upstream electrodes 8*a*, 9*a* of each pair, and in broken lines, the value of the alternating supply voltage of the downstream electrodes 8*b*, 9*b* of each pair. A threshold value Vs is then determined for each of the voltages applied to the electrodes of the pair, 8*a* and 8*b*. When an order to form a jet break is received to form an odd jet segment, the pulse command to the corresponding actuator is delayed to make it coincide with the moment closest to which the voltage of the electrode 8*a* has the threshold value Vs. When an order to form a break is received to form an odd jet segment, the pulse order to the corresponding actuator is delayed to make it coincide with the moment closest to which the voltage of the electrode 8*b* has the threshold value Vs. The voltages supplying the electrodes 8*a* and 8*b* being in phase opposition, the pulse orders to the actuators to form even jet segments are always shifted by 180° relative to the pulse orders to the actuators to form odd jet segments. It will be noted that according to this alternative of the method, the break moments of the jets to form printing drops (not electrically influenced by the electrodes) are temporally shifted to the maximum of a period of the supply voltage of the electrodes, both for the even jets and for the odd jets. The average value of the shift is a half-period. This means that all of the pattern to be printed is shifted by a half-period, and that inside the pattern to be printed, the average default is a quarter of a period. Typically, for a supply frequency of the electrodes in the vicinity of a hundred kHz, and a relative speed of the printing medium 12 relative to the head 20 of about 4 m/s, the average of the printing deviations relative to the ideal (theoretical) positions is in the vicinity of 10 μm, which is completely acceptable on the scale of a pattern to be printed on a printing medium. In other words, this alternative of the method makes it possible to minimize the electrical charges taken on the jet segments, and therefore to avoid premature soiling of the electrodes, with a minute spatial printing shift.

Figure 7:
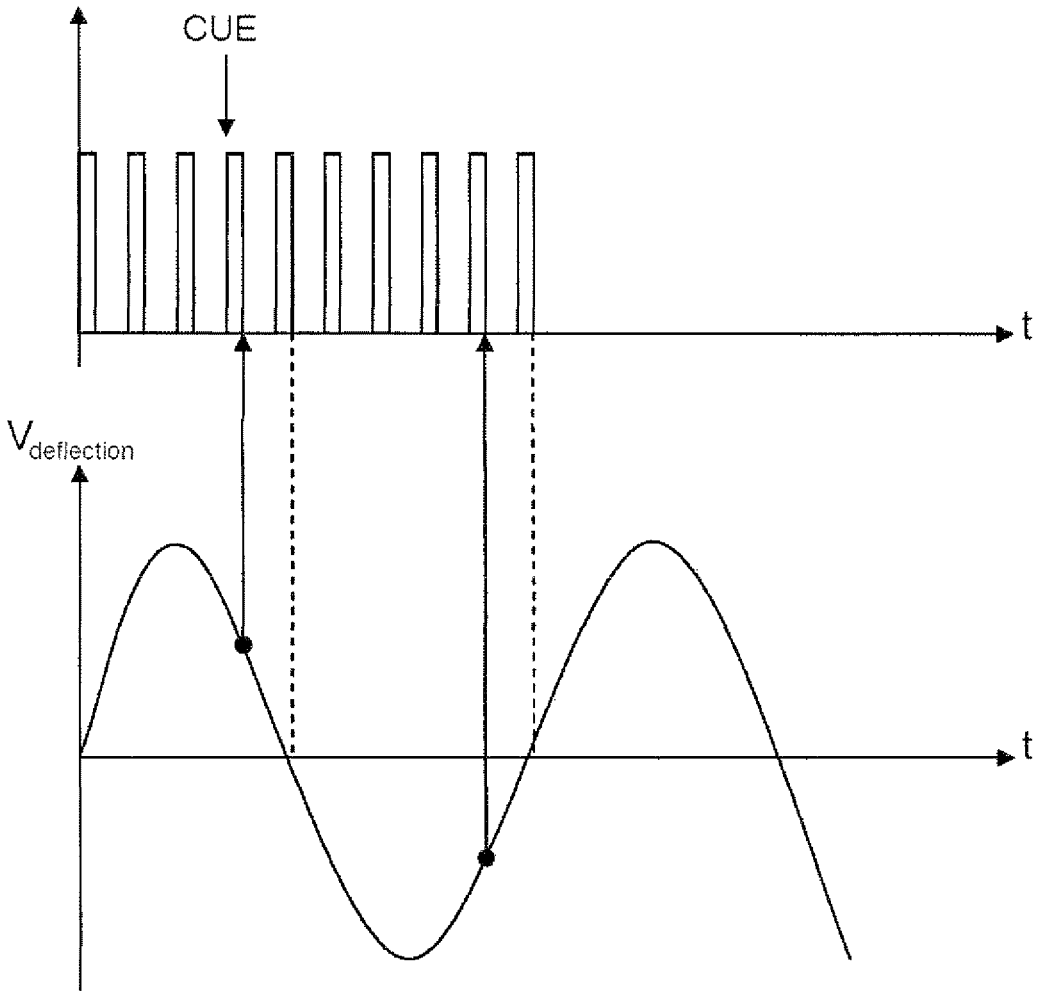
FIG. 7 shows, in correspondence, a series of pulses produced by a clock signal from software for controlling the printing and an alternating voltage supplying a deflection electrode of a printhead according to the invention.

A second alternative to obtain an order of the actuators 6 so as to form an odd jet segment, while the phase of the supply potential of the electrode 8*a* has a value $\phi$, and to form an adjacent even jet segment when the phase of the supply potential of that same electrode 8*a* has a value close to $\phi$+180°, is indicated below relative to FIG. 7. FIG. 7 shows, in correspondence, a succession of pulses of a reference clock, for example control software for controlling the printing, which controls the pulses of the actuators 6 and an alternating voltage supplying a deflection electrode of a printhead according to the invention. The frequency $F_h$ of the clock is very high, in the vicinity of several tens of Mhz, here 32 Mhz.

From this clock frequency, the frequency $F_t$ of the alternating supply voltage of the pairs of electrodes 8*a*, 8*b* and 9*a*, 9*b* is given as being a whole sub-multiple, preferably greater than 20, of the clock frequency $F_h$ and period $P_h$. Here, a frequency $F_t$ of 80 Khz is chosen, or a whole multiple having a value of 400.

The operation of this second alternative is as follows: Depending on the relative position between the printhead and printing support, a printing order cue is received on the input 16 by the printing control means 13.

a) A pulse is immediately sent to the actuators 6, to form the odd segments necessary given the pattern to be printed, from the corresponding position of that order cue.

b) The pulses from the clock with frequency $F_h$ are counted from the sending of the pulses to the odd actuators triggered by the reception of the information from the position cue of the medium.

c) For the same relative position between the printing medium 12 and printhead, the sending of the pulses to the actuators to form even jet segments is delayed until the number i of pulses counted by the clock reaches a value corresponding to the duration closest to the half-period of the alternating supply voltage of the deflection electrodes. It is specified here that, for better precision, it is preferable for the sub-multiple of the clock frequency to be an even integer, for example 2n, n being an integer because, when the number of counted pulses i reaches n, an exact half-period of the period of the supply frequency of the deflection electrodes has elapsed. That said, if the sub-multiple is not an even integer, and is for example equal to 21, and the counting of pulses is stopped when the number i is equal to 10, the phase shift relative to 180° is less than 9°, which is still acceptable.

d) Steps a) to c) are started again for each new position cue received on the input 16 by the control means 13. Since the number i is the number of periods of the clock frequency that substantially corresponds to a half-period of the supply frequency of the electrodes 8*a*, 8*b*; 9*a*, 9*b*, it is thus possible to be sure that the pulse orders of the actuators to form even and odd jet segments still have a phase shift of 180° or close to 180° between them. Thus if the even segments are negatively charged, the odd segments are positively charged. The electrical charge of each of the first elementary volumes, and therefore the total charge contained in the influence volume of the electrodes, i.e. those taken on by the jet segments inside said volume, are minimized.

Step a) can be replaced by step a'), according to which the pulses are sent to the odd actuators with a delay, so that the break moment of the jets coincides with the first passage by 0 or close to 0, of the value of the alternating supply voltage of the deflection electrodes 8*a*, 8*b*; 9*a*, 9*b* that follows the determination of the position information.

It should be noted that necessarily, the break moment of a jet does not coincide exactly with the moment where an ordered pulse reaches an actuator.

The break moment is delayed on the pulse, by a duration that essentially depends on the speed of the jet and the break distance Lbr. The explanations provided use as implicit hypothesis that this duration has a constant value. To make a break coincide with a passage by 0 of the supply voltage of the deflection electrodes, one first calculates an average value of that duration to determine the sending moment of the pulse. Because it involves an average value, the actual break moment may not coincide exactly with the moment of passage by 0 of the supply voltage of the deflection electrodes, but the actual moment is close enough for the supply voltage and therefore the electrical charge taken on to be low.

This second alternative therefore still involves a phase shift of 180° between the break moment to form an even jet segment and the break moment to form an odd jet segment. It also guarantees that the break moments occur when the supply voltage of the electrodes is zero or very close to zero. In this way, the segments formed are individually charged little or not at all and the probability of microdroplet formation is therefore reduced. Furthermore, as already explained, the microdroplets formed, if there are any, are not very charged and have a low probability of being attracted by the electrodes. The maximum spatial shift introduced between the actual position of the printing drops, the formation of which has been temporally shifted according to the second alternative, is:

$$\Delta x = V \times P_t \quad (1)$$

in which:

V represents the relative velocity between the printing support 12 and the printhead;

$P_t$ represents the period of the supply frequency of the deflection electrodes 8*a* to 9*b*.

Typically, for a velocity V=4 m/s and a deflection supply frequency $F_t$=80 kHz, a maximum shift Δx of 50 μm is obtained and an average value of 25 μm, which is perfectly acceptable on the scale of a pattern to be printed on a printing medium. In other words, this alternative of the method makes it possible to minimize the electrical charges taken on by the jet segments, and therefore to avoid premature soiling of the electrodes, with a minute spatial printing shift.

According to a second embodiment of the invention, one seeks to minimize the charge taken on in a second elementary volume assembly in which each elementary volume is a volume found in the influence volume of the electrodes and surrounding a single jet. Thus, an elementary volume of the second assembly corresponding to this second embodiment can be defined as a volume delimited by six planes, two first planes parallel to the plane of the nozzles, and two pairs of second planes perpendicular to each other and to the plane of the nozzles. The pairs of second planes are positioned so that a single jet axis passes through the volume delimited by the six planes.

To decrease the charge taken on according to this second embodiment, the following steps are carried out, for each jet coming from a nozzle:

e) the number of periods of a reference clock with frequency $F_h$ and period $P_h$ is determined between a pulse sending moment causing the formation of a drop necessary to obtain the pattern to be printed, and the consecutive moment causing a consecutive drop, also necessary to obtain the pattern to be printed, f) the length of the intermediate jet segment to be formed between the two consecutive drops during the number of periods determined in step e) is determined from the velocity of the jet, g) if the part of the intermediate segment furthest downstream is at a level further downstream than the lower end of the even electrode 9*b* furthest downstream of the deflection assembly, or is at an even electrode 8*b*, 9*b*, no advance or delay is introduced relative to the moment provided for sending pulses to form the segment, h) if the part of said intermediate segment furthest downstream is at a level further upstream than the lower end of the even electrode 9*b* the furthest downstream of the deflection assembly and at an odd electrode of a given pair 8*a*, 9*a*, the sending of pulses to form the segment is temporally shifted by a value Δt so that at the break moment of the latter, the potential value applied on the deflection electrodes 8*a*, 8*b*; 9*a*, 9*b* is zero or close to zero.

In order to simplify the printing order, step g) can be replaced by a step g') according to which if the part of the intermediate segment furthest downstream is at a level further downstream than the lower end of the even electrode 9*b* the furthest downstream of the deflection assembly, no advance or delay is introduced relative to the moment provided for sending pulses to form said jet.

In this case, step h is replaced by a step h') according to which if the part of said intermediate segment furthest downstream is at a level further upstream than the lower end of the even electrode 9*b* the furthest downstream of the deflection assembly, the sending of pulses to form the segment is temporally shifted by a value Δ't so that at the break moment of the latter, the potential value applied to the deflection electrodes 8*a*, 8*b*; 9*a*, 9*b* is zero or close to zero. Thus, in this alternative of the second embodiment of the invention, all of the segments with a long enough length to have, at the moment of their formation, a part further downstream than the even electrode furthest downstream 9*b*, the sequencing initially provided is not modified. On the other hand, for all of the other segments, one does not try to determine where their furthest downstream part is located at the moment of their formation and the pulse sending moment is shifted so that the break coincides with a passage of the supply voltage by 0, or close to 0. The temporal shift Δt or Δ't of the pulses to form a segment in order to form the following drop can be a time delay or advance. Preferably, the smallest time shift between the advance and the delay is chosen.

In the first embodiment as well as in the second embodiment with steps g') and h'), because the charge taken on by the segments at the break moment is zero or close to zero, the electrostatic forces on the segments due to the electrical charges taken on are minimized. As a result, the probability of the appearance of microdroplets is decreased. Likewise, even in case of appearance of microdroplets, they are necessarily not very charged. They therefore have a low probability of undergoing a strong enough electrostatic attraction by the electrodes for them to come into contact with the latter.

Of course, the description provided for the even jet segments relative to the odd jet segments also applies vice versa. Thus, for the first embodiment, it is also possible to form an even jet segment when the phase of the supply potential of the electrode 8*a* has a value ϕ instead of the odd segment.

The invention claimed is:

1. A control method for controlling printing by a binary continuous inkjet printer provided with a printhead, or a printhead of such a printer in order to print a pattern on a printing medium in motion relative to the head, the method comprising:

determining information on a relative position of the printing medium in relation to the printhead;

supplying each of a pair of electrodes with alternating voltage in phase opposition relative to each other;

sending pulses to actuators to form, from a break of a jet discharged by a nozzle in communication with a stimulation chamber to which one said actuator is mechanically coupled at a distance from a plane of the nozzle, drops not able to be electrically charged by deflection electrodes or jet segments subject to electrostatic influence of the deflection electrodes; and controlling said pulses so as to minimize a total electric charge on the jet segments, said total electric charge being contained inside an electrostatic influence volume of the deflection electrodes, wherein the printhead comprises a multi-nozzle drop generator which includes a body, said body including one or more said stimulation chambers each able to receive pressurized ink, and discharge nozzles each provided in communication with one of said stimulation chambers and each able to discharge a jet of ink along its longitudinal axis, the discharge nozzles being aligned along an alignment axis and arranged in a same plane;

a plurality of said actuators, each said actuator being mechanically coupled to one of said stimulation chambers and able to cause, on pulse control, a break of the jet discharged by each said discharge nozzle in communication with said chamber at the distance from the plane of the discharge nozzles; and a deflection assembly arranged below the discharge nozzles and including, from upstream to downstream, a shielding electrode, a first dielectric layer adjacent to the shielding electrode, and at least one of said pairs of deflection electrodes, each said deflection electrode being surrounded on either side by a dielectric layer.

2. The control method according to claim 1, wherein, using two jet segments formed from two adjacent discharge nozzles each having different parity, the pulses are controlled to form a plurality of even jet segments, when the phase of the voltage of one of the deflection electrodes has a value Φ, and the pulses are controlled to form a plurality of odd jet segments when the phase of the voltage of the same deflection electrode has a phase shifted value of 180° or about (Φ+180°).

3. The control method according to claim 2, wherein the pulses are sent to obtain breaking of the plurality of even jets and the plurality of odd jets in order to form segments when an absolute value of a potential of the deflection voltage of the electrode is about zero.

4. The control method according to claim 2, wherein, in order to obtain the phase shifted value (Φ+180°) between break moments of a plurality of even jets and break moments of a plurality of odd jets, a supply frequency Ft of the deflection electrodes is determined as a whole number of a sub-multiple of a reference clock with frequency $F_h$ and period $P_h$, and wherein the following steps are subsequently performed:

a) sending a pulse immediately to the plurality of actuators to form the plurality of odd jet segments necessary for a pattern to be printed, based on information on the relative position determined between medium and printhead;

b) counting clock pulses with frequency $F_h$ from sending of the pulses to odd actuators triggered by the relative position information determined between printing medium and printhead;

c) for the same relative position between the printing medium and printhead, delaying the sending of the pulses to the plurality of actuators to form said plurality of even jet segments necessary for the pattern to be printed until a number i of pulses counted by a clock according to step b) corresponds to a duration closest to a half-period of the alternating supply voltage of the deflection electrodes; and d) repeating steps a) to c) for each currently amended relative determined position information between the printing medium and the printhead.

5. The control method according to claim 2, wherein, in order to obtain the phase shifted value (Φ+180°) between break moments of the plurality of even jet segments and break moments of the plurality of odd jet segments, a supply frequency Ft of the deflection electrodes is determined as a whole number of a submultiple of a reference clock with frequency $F_h$ and period $P_h$, and wherein the following steps are subsequently performed:

a) sending pulses to the actuators on a delay to form the plurality of odd jet segments, so that a break moment coincides when the first passage by about 0, of the value of the alternating supply voltage of the deflection electrodes that follows the determination of the position information;

b) counting clock pulses with frequency $F_h$ from sending of the pulses to the odd actuators triggered by the relative position information determined between printing medium and printhead;

c) for the same relative position between the printing medium and printhead, delaying the sending of the pulses to the actuators to form the plurality of even jet segments necessary for the pattern to be printed until a number i of pulses counted by a clock according to step b) corresponds to a duration closest to a half-period of the alternating supply voltage of the deflection electrodes; and d) repeating steps a) to c) for each currently amended relative determined position information between the printing medium and the printhead.

6. The control method according to claim 1, wherein for each jet coming from a nozzle, the following steps are performed:

determining a number of periods of a reference clock with frequency $F_h$ and period $P_h$ between a pulse sending moment causing formation of a drop necessary to obtain a pattern to be printed, and a consecutive moment causing a consecutive drop also necessary to obtain the pattern to be printed;

determining a length of an intermediate jet segment to be formed between the two consecutive drops during said determined number of periods based on a velocity of the jet;

introducing no advance or delay relative to a planned moment for sending pulses to form the intermediate segment, if a part of the intermediate segment furthest downstream is at a level further downstream than a lower end of the even electrode furthest downstream of a deflection assembly, or is at a level of a downstream electrode of a given pair; and temporarily shifting the sending of pulses to form the intermediate segment by a value Δt to form the intermediate segment so that at a break moment thereof, the potential value applied on the deflection electrodes is about zero, if the part of said intermediate segment furthest downstream is at a level further upstream than the lower end of the even electrode furthest downstream of the deflection assembly and at a level of an upstream electrode of a given pair.

7. The control method according to claim 6, wherein the temporal shift Δt is an advance or a delay relative to a consecutive moment for forming the intermediate segment, the advance or delay being chosen so as to minimize the value of said temporal shift Δt.

8. The control method according to claim 1, wherein for each jet coming from a nozzle, the following steps are performed:

determining a number of periods of a reference clock with frequency $F_h$ and period $P_h$ between a pulse sending moment causing formation of a drop necessary to obtain a pattern to be printed, and a consecutive moment causing a consecutive drop also necessary to obtain the pattern to be printed;

determining a length of an intermediate jet segment to be formed between the two consecutive drops during said determined number of periods based on a velocity of the jet;

introducing no advance or delay relative to a planned moment for sending pulses to form the intermediate segment, if a part of the intermediate segment furthest downstream is at a level further downstream than a lower end of the even electrode the furthest downstream of the deflection assembly; and temporarily shifting the sending of pulses to form the intermediate segment by a value Δ't so that at a break moment thereof, a potential value applied on the deflection electrodes is about zero, if the furthest downstream part of said intermediate segment is at a level further upstream than the lower end of the even electrode the furthest downstream of the deflection assembly.

9. The control method according to claim 8, wherein the temporal shift Δ't is an advance or a delay relative to a consecutive moment for forming the intermediate segment, the advance or delay being chosen so as to minimize the value of said temporal shift Δ't.

* * * * *